US005714933A

United States Patent [19]

Le Van Suu

[11] Patent Number: 5,714,933

[45] Date of Patent: Feb. 3, 1998

[54] SYSTEM FOR PROTECTION OF GOODS AGAINST THEFT

[75] Inventor: Maurice G. Le Van Suu, Romainville, France

[73] Assignee: SGS-Thomson Microelectronics S.A., Saint Genis, France

[21] Appl. No.: 584,021

[22] Filed: Jan. 11, 1996

[30] Foreign Application Priority Data

Jan. 10, 1995 [FR] France ..... 95 00333

[51] Int. Cl.[6] ..... G08B 13/14

[52] U.S. Cl. ..... 340/568; 340/531; 340/538; 340/539; 340/669; 340/689

[58] Field of Search ..... 340/539, 531, 340/568, 669, 689, 538

[56] References Cited

U.S. PATENT DOCUMENTS

| | | | |
|---|---|---|---|
| 4,337,462 | 6/1982 | Lemelson | 340/539 |
| 4,818,970 | 4/1989 | Natale et al. | 340/539 |
| 4,885,564 | 12/1989 | Vercellotti et al. | 340/310 R |
| 5,317,304 | 5/1994 | Choi | 340/571 |
| 5,543,778 | 8/1996 | Stouffer | 340/539 |

FOREIGN PATENT DOCUMENTS

| | | | |
|---|---|---|---|
| A-0 312 431 | 4/1989 | European Pat. Off. | G08B 25/00 |
| A-28 15 183 | 10/1979 | Germany | G08B 29/00 |
| C-41 41 035 | 12/1991 | Germany | G08B 25/10 |

OTHER PUBLICATIONS

French Search Report from French Patent Application 95 00333, filed Jan. 10, 1995.

*Primary Examiner*—Glen Swann

*Attorney, Agent, or Firm*—Wolf, Greenfield & Sacks, P.C.; James H. Morris

[57] ABSTRACT

A system for protection of goods against theft includes a control unit and protection modules associated with the goods, the control unit including cordless communication means and the protection modules including movement detection circuitry to find out whether the goods are being handled, and cordless communications circuitry to send an alarm message to the control unit if a movement is detected.

23 Claims, 1 Drawing Sheet

SYSTEM FOR PROTECTION OF GOODS AGAINST THEFT

BACKGROUND OF THE INVENTION

1. Field of the Invention

The invention relates to a system for protection of goods against theft.

2. Discussion of the Related Art

At present, there are two types of systems for protection of goods.

Standard electronic alarm systems, designed for the protection of premises, provide indirect protection for the goods located on these premises. These systems are based on the detection, by various means (such as window-opening contact detectors, volumetric sensors, laser sensors, infrared sensors etc.), of intrusion by unauthorized persons into these premises. The term "premises" must be understood in a broad sense. It could be applied to a house, a building with offices, a car, etc. These systems are inefficient against the theft of goods, located in premises, by persons authorized to be in these premises. Thus, for example, they cannot prevent the employees of a firm from pilfering, during working hours, goods owned by the firm, for example goods such as computers, telephones, etc.

There also exist devices for direct protection of goods against theft. In general, these are mechanical protective devices. For example, the goods to be protected are chained to a shelf. The goods could also be kept in strong boxes or cupboards under lock and key. This means that it is impossible to have them at hand. There also exist passive electronic systems based on the labelling of goods with magnetic labels. These systems are more especially used in big stores. These labels prompt alarms when they are subjected to a magnetic field. In practice, this means that people have to be required to pass through checking gates.

SUMMARY OF THE INVENTION

It is an aim of the invention to provide an active system for direct protection of goods against theft. The term "active system" is understood to mean a system wherein the goods to be protected are fitted out with means capable of taking the initiative to communicate within an information broadcasting system in order to report any anomaly after detection.

Thus, the invention provides a system for protection of goods against theft comprising a control unit and protection modules associated with the goods, the control unit comprising cordless communications means and the protection modules comprising means for the detection of movement to find out if the goods are being handled, and means of cordless communication to send an alarm message to the control unit if a movement is detected.

BRIEF DESCRIPTION OF THE DRAWINGS

Other advantages and particular features shall emerge from the following detailed description of an exemplary embodiment of the invention, given by way of an indication that in no way restricts the scope of the invention and made with reference to the appended drawings of which.

DETAILED DESCRIPTION

Figure 1:
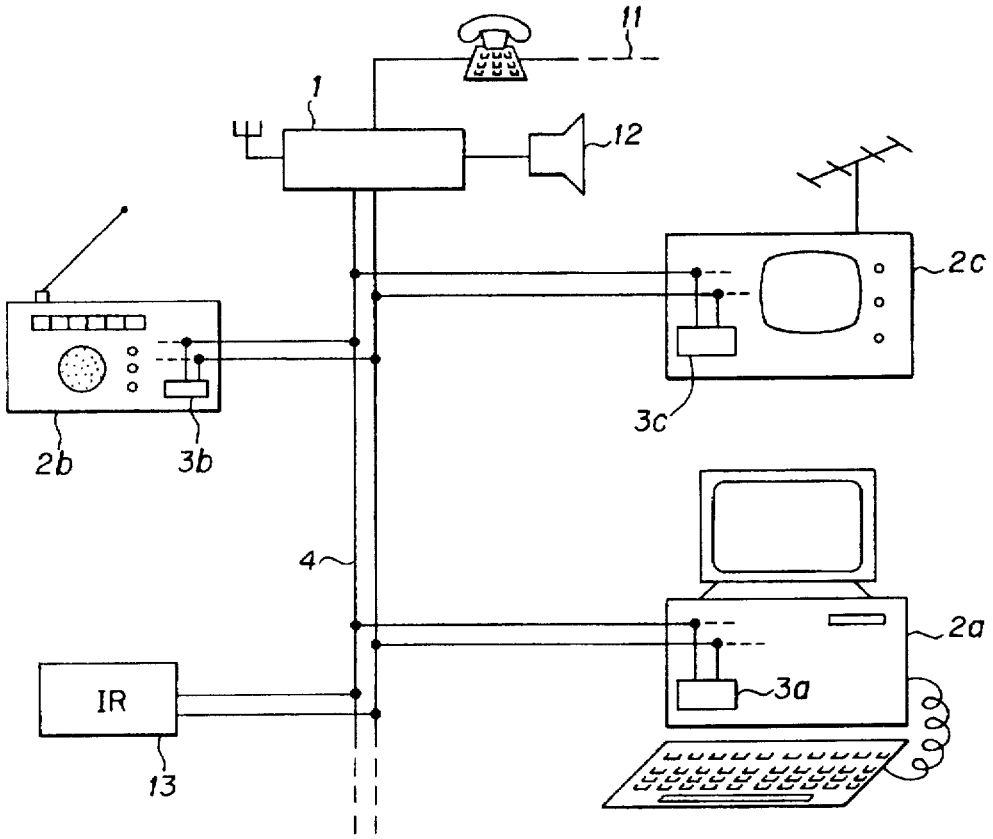
FIG. 1 shows a schematic drawing of a protection system made according to the invention.

The system shown in FIG. 1 comprises:

a control unit 1;

goods 2*a*, 2*b*, 2*c*;

protection modules 3*a*, 3*b*, 3*c* respectively associated with the goods 2*a*, 2*b*, 2*c*; and a fixed communications medium 4 to which the control unit 1 and the goods are connected so that the control unit 1 and the goods can communicate with each other. The term "fixed medium" is understood to mean a medium to which the control unit 1 and the goods are physically connected.

The goods 2*a*, 2*b*, 2*c* will be, for example, electrical appliances such as television sets, radios, computers, hi-fi systems, etc. They could also be, for example, furniture, works of art, etc. The protection modules 3*a*, 3*b*, 3*c* take the form, for example, of electronic cards fitted into the goods to be protected.

Advantageously, the electrical power distribution system will be used as a fixed communications medium 4. Communications between the control unit 1 and the protection modules 3*a*, 3*b* and 3*c* will be done by means of carrier current in the form of exchanges of binary messages, each piece of goods connected to the medium 4 being characterized by a particular address. It is also possible to use communications lines, for example a twisted pair, dedicated to the system, that are different from the electrical power distribution system. This would have the disadvantage of making it necessary to set up such lines and would therefore entail additional costs of manufacture, installation and maintenance.

The control unit 1 will be typically fitted out with a microprocessor, means of communication through the fixed medium 4, cordless communications means, for example by RF, and a user interface comprising, for example, a keyboard and a screen to enable the user to program the working of the system. The control system shall not be described in greater detail as it should not raise any particular problems of construction for technicians familiar with home automation systems.

Figure 2:
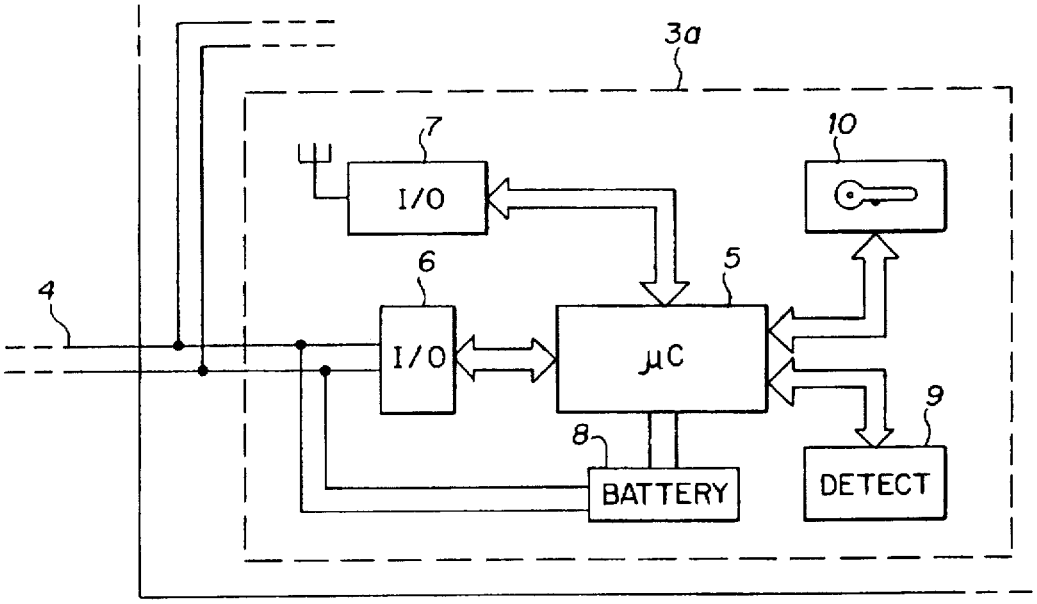
FIG. 2 gives a schematic view of a module for the protection of goods according to the system illustrated in FIG. 1.

The protection module 3*a* illustrated in FIG. 2 described by way of an example, comprises:

information processing means, for example a microcontroller 5, to manage the function of protecting the piece of goods;

communication means 6 for communication through the fixed medium 4 or modem, connected firstly to the microcontroller 5 and secondly to the fixed communications medium 4 to enable the transmission of information elements from the module 3*a* to the control unit 1 and the reception of information elements or commands coming from the control unit 1 to the module 3*a* by means of the fixed communications medium 4;

cordless communication means 7, for example by RF, connected to the microcontroller 5 to enable the transmission of information elements from the module 3*a* to the control unit 1 and the reception of information elements or commands coming from the control unit 1 to the module 3*a*, by means of radiofrequencies;

independent supply means 8 connected to the microcontroller 5 to supply said microcontroller if the piece of goods 2*a*, and therefore the protection module 3*a*, is disconnected from the electrical power distribution system; and movement detection means 9 connected to the microcontroller 5 to produce an information element on movement in the form of a digital message when a movement of the piece of goods is detected, this information element on movement being given to the microcontroller 5.

The composition of these different elements shall not be described in greater detail, it being understood that they entail no problems of construction for those skilled in the art.

The independent supply means 8 include, for example, a back-up battery rechargeable through the mains and consequently connected to the electrical supply circuit of the item.

The movement detection means 9 comprise, for example, one or more of the following devices:

mercury circuit-breaker;

mercury switch mechanism;

push-button; and ball-operated device.

As regards its operation, the system will work, for example, in the way described below.

If the movement detection means 9 of the module 3*a* detect a movement of the piece of goods 2*a*, they send a message to the controller 5 of the protection module 3*a*. This message could include simply a change of logic level of a signal, this signal being received by an interrupt input of the microcontroller 5. The microcontroller 5 then sends an alarm message to the control unit 1 through the RF communication means 7. The microcontroller 5 could also send the alarm message simultaneously through the fixed medium 4. This message includes the address of the transmitter, namely the reference of the piece of goods 2*a* fitted out with the module 3*a* which sends the message, and the address of the destination, namely the reference of the control unit 1.

After reception of the alarm message, the control unit 1 sends a message by RF channels to the protection module of the piece of goods from which this alarm message comes. This message sent by the control unit 1 is a message asking for a confirmation of the alarm message through the fixed communication medium 4.

If the protection module associated with this piece of goods is not disconnected from the fixed communication medium 4, it may send a message confirming the alarm message by carrier current through this medium 4. The confirmation message could be the initial alarm message in a form that is of course suited to the medium 4. Since this medium 4 is fixed, it may be assumed that the piece of goods is not being stolen. Theft is possible only if the piece of goods is disconnected from the fixed communication medium 4. For greater security, it may be planned that the protection module will send the confirmation message back a certain number of times through the fixed communication medium 4.

If the protection module associated with the article is disconnected from the medium 4, the control unit 1 will never receive the confirmation message by carrier current. It could, if necessary, after a certain fixed or programmable period of time, request a confirmation of the alarm message by RF channels.

In both cases, the control unit 1 may still receive an alarm confirmation message before activating an alarm procedure. This alarm procedure includes, for example, sending a message through a telephone line 11 to a police station and/or in setting off a siren 12.

In order to enable goods to be handled without having to deactivate the entire system, an interface 10 may be provided at each protected piece of goods to deactivate the protection module of this piece of goods. The term "deactivated module" is understood to mean a module that does not send any alarm message if the piece of goods with which it is associated is shifted. This interface will comprise, for example, a keyboard enabling the protection module to be turned on or off. It could also be a lock or a chip card reader. It is also possible to provide for the deactivation of the protection modules individually, from the control unit.

It is also possible to provide for deactivating the entire system through the interface using the control unit 1.

It is also possible to make provision in the system, alternately or in conjunction with the RF communication, for infrared communication. In this case, the system will have one or more communication modules 13 in the vicinity of the goods to be protected. In one exemplary embodiment, the protection modules 3*a*, 3*b* and 3*c* will be provided with infrared communication means, typically laser diodes. The communication module 13 will be provided with an infrared receiver and an interface to communicate by means of the fixed medium 4. From an operational point of view, if one of the goods coming out of the reception field of the communications module 13 (namely the link between the module for the protection of the piece of goods and the infrared receiver of the communications module 13) is interrupted, the latter will send an alarm message to the control unit through the fixed medium 4.

Having thus described at least one illustrative embodiment of the invention, various alterations, modifications, and improvements will readily occur to those skilled in the art. Such alterations, modifications, and improvements are intended to be within the spirit and scope of the invention. Accordingly, the foregoing description is by way of example only and is not intended as limiting. The invention is limited only as defined in the following claims and the equivalents thereto.

What is claimed is:

1. A system for protection of goods against theft comprising a control unit and protection modules associated with the respective goods, the control unit comprising cordless communications means and the protection modules comprising movement detection means to determine when the respective goods are being moved, and cordless communications means to send an alarm message to the control unit when movement of the respective goods is detected wherein the control unit and the protection modules each comprises means for communicating through a fixed communications medium; and wherein, following reception of the alarm message from a protection module, the control unit sends a message by RF means requesting confirmation of the alarm message through the fixed communications medium.

2. A system according to claim 1, wherein the cordless communications means of the control unit and of the protection modules are RF communications means.

3. A system according to claim 1, wherein the protection modules send an alarm message to the control unit, simultaneously through the cordless communications means and through the fixed communications medium, when movement of the respective goods with which each protection module is associated is detected.

4. A system according to claim 1, wherein, when there is no confirmation of the alarm message received through the fixed communications means, the control unit sends a request, by RF means, after a certain period of time, for a confirmation of the alarm message by RF means.

5. A system according to claim 1, wherein the fixed communications medium is an electrical power distribution system.

6. A system according to claim 1, wherein the protection modules each comprises an interface to deactivate the respective protection module.

7. A system according to claim 1, wherein each protection module comprises infrared communications means.

8. The system according to claim 1, wherein the protection module sends the confirmation through the fixed communications medium.

9. The system according to claim 1, further comprising an IR receiver coupled to the fixed communications medium; and wherein the cordless communications means in the protection modules includes an IR transmitter.

10. A method for protecting an item from unauthorized movement, the method comprising steps of:

(a) detecting movement of the item;

(b) when movement of the item is detected, sending an alarm message via cordless communications;

(c) when the alarm message is received via cordless communications, sending a request for a confirmation of the alarm message and requesting that the confirmation be sent via a fixed communications medium; and (d) when the confirmation has not been received via the fixed communication medium, determining that the item has been moved without authorization.

11. The method as recited in claim 10, wherein step (d) includes a step of:

waiting a predetermined amount of time after the request for the confirmation has been sent in step (c) before determining that the item has been moved without authorization.

12. The method as recited in claim 10, wherein step (c) includes a step of:

sending the request for the confirmation of the alarm message via cordless communications.

13. The method as recited in claim 10, further comprising steps of:

receiving the request for confirmation; and sending the confirmation via the fixed communications medium.

14. The method as recited in claim 10, wherein step (d) comprises steps of:

waiting a predetermined amount of time after the request for confirmation has been sent; and when the predetermined mount of time has passed and no confirmation has been received via the fixed communications medium, sending a new request for the confirmation to be sent via cordless communications.

15. A method for protecting an item from unauthorized movement, the method comprising steps of:

(a) detecting when the item is moved;

(b) when the item has been moved, sending an alarm message via cordless communications; and (c) when the alarm message has been received, sending a request for a confirmation of the alarm message and requesting that the confirmation be sent via a fixed communications medium.

16. The method as recited in claim 15, further comprising steps of:

(d) sending the confirmation via the fixed communications medium; and (e) receiving the confirmation via the fixed communications medium.

17. The method as recited in claim 16, further comprising a step of:

repeating steps (d)–(e) a predetermined number of times.

18. The method as recited in claim 15, further comprising a step of:

(d) when the confirmation has not been received via the fixed communications medium, determining that the item has been moved without authorization.

19. The method as recited in claim 18, wherein step (d) includes a step of:

waiting a predetermined amount of time after the request for confirmation has been sent in step (c) before determining that the item has been moved without authorization.

20. A method for determining whether or not an item has been improperly moved in a system including a control unit and a protection module coupled to the item, the control unit coupled to the protection unit via a fixed communications medium, the control unit including a first cordless communications device and the protection module including a second cordless communications device and a motion detector, the method comprising steps of:

detecting movement of the item by the motion detector; and the protection unit sending an alarm message to the control unit via the second cordless communications device; and the control unit receiving the alarm message and sending a request to the protection unit to send a confirmation via the fixed communications medium.

21. The method as recited in claim 20, further comprising steps of:

the protection unit sending the confirmation to the control unit via the fixed communications medium; and upon receipt of the confirmation, the control unit determining that the item has not been improperly moved.

22. The method as recited in claim 20, further comprising a step of:

when the control circuit does not receive the confirmation via the fixed communications medium, the control unit determining that the item has been improperly moved.

23. The method as recited in claim 22, further comprising a step of:

the control unit waiting a predetermined period of time after sending the request for confirmation before determining whether or not the confirmation has been received.

* * * * *